US007329207B1

(12) United States Patent
Maresh

(10) Patent No.: US 7,329,207 B1
(45) **Date of Patent: *Feb. 12, 2008**

(54) EXERCISE APPARATUS WITH ELLIPTICAL FOOT MOTION

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 109 days.

This patent is subject to a terminal disclaimer.

(21) Appl. No.: 11/058,398

(22) Filed: Feb. 14, 2005

Related U.S. Application Data

(63) Continuation of application No. 10/634,136, filed on Aug. 4, 2003, now Pat. No. 6,855,094, which is a continuation-in-part of application No. 10/066,029, filed on Jan. 31, 2002, now Pat. No. 6,786,851, and a continuation-in-part of application No. 09/065,308, filed on Apr. 23, 1998, now Pat. No. 7,086,993.

(60) Provisional application No. 60/044,957, filed on Apr. 26, 1997, provisional application No. 60/489,196, filed on Jul. 21, 2003.

(51) Int. Cl.
*A63B 22/00* (2006.01)
*A63B 22/04* (2006.01)

(52) U.S. Cl. ..... 482/52; 482/57

(58) Field of Classification Search ..... 482/51–52, 482/57, 70, 79–80
See application file for complete search history.

(56) References Cited

U.S. PATENT DOCUMENTS

| | | | | |
|---|---|---|---|---|
| 5,759,136 | A * | 6/1998 | Chen | 482/57 |
| 5,762,588 | A * | 6/1998 | Chen | 482/57 |
| 5,779,599 | A * | 7/1998 | Chen | 482/57 |
| 6,786,851 | B1 * | 9/2004 | Maresh | 482/52 |
| 6,855,094 | B1 * | 2/2005 | Maresh | 482/52 |

* cited by examiner

*Primary Examiner*—Stephen R. Crow

(57) ABSTRACT

An exercise apparatus includes left and right rigid connector links having first portions rotatably connected to respective cranks, second portions constrained to move in reciprocating fashion, and third portions connected to respective foot supports. Intermediate links are also interconnected between respective cranks and respective foot supports. The resulting assembly links rotation of the cranks to movement of the foot supports through generally elliptical stepping paths. The connection points may be moved relative to one another and/or a supporting frame to adjust the size, shape, and/or orientation of the paths.

2 Claims, 8 Drawing Sheets

EXERCISE APPARATUS WITH ELLIPTICAL FOOT MOTION

CROSS-REFERENCE TO RELATED APPLICATIONS

This is a continuation of U.S. patent application Ser. No. 10/634,136, filed Aug. 4, 2003, now U.S. Pat. No. 6,855,094, which in turn, (1) is a continuation-in-part of (a) U.S. patent application Ser. No. 10/066,029, filed Jan. 31, 2002; now U.S. Pat. No. 6,786,851, and (b) U.S. patent application Ser. No. 09/065,308, filed Apr. 23, 1998, now U.S. Pat. No. 7,086,993, which in turn, discloses subject matter entitled to the filing date of U.S. Provisional Application Ser. No. 60/044,957, filed on Apr. 26, 1997; and (2) discloses subject matter entitled to the filing date of U.S. Provisional Ser. No. 60/489,196, filed Jul. 21, 2003.

FIELD OF THE INVENTION

The present invention relates to exercise methods and apparatus and more particularly, to exercise equipment that facilitates a generally elliptical foot motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Still another type of exercise equipment has been designed to facilitate generally elliptical exercise motion.

A variety of elliptical motion exercise machines have been disclosed in patents, including U.S. Pat. No. 4,185,622 to Swenson, the position that these Miller patents (one of which was the subject of a reexamination proceeding) cover any elliptical motion machine that generates more heel rise than toe rise as a person's foot begins moving forward on the machine. Therefore, an object of the present invention is to provide an elliptical motion exercise machine that guides a person's feet in a way that falls outside the "heel rise" language in the Miller claims.

SUMMARY OF THE INVENTION

The present invention may be described in terms of novel linkage assemblies and corresponding exercise apparatus suitable for generating generally elliptical foot motion. On each side of certain exemplary embodiments, a first portion of a connector link is rotatably connected to a crank; a second portion of the connector link is rotatably connected to a rocker link; and a third portion of the connector link is rotatably connected to a foot support. Also, an intermediate link or orientation controlling means is movably interconnected between the foot support and the crank to control the orientation of the foot support so there is not more heel rise than toe rise during the transition from rearward foot travel to forward foot travel.

On one depicted embodiment, the orientation controlling means is a floating crank link, and the foot support is pivotally connected to a distal end of the connector link. On another depicted embodiment, the orientation controlling means is a roller, and the foot support is pivotally connected to an intermediate portion of the connector link. Many features and/or advantages of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
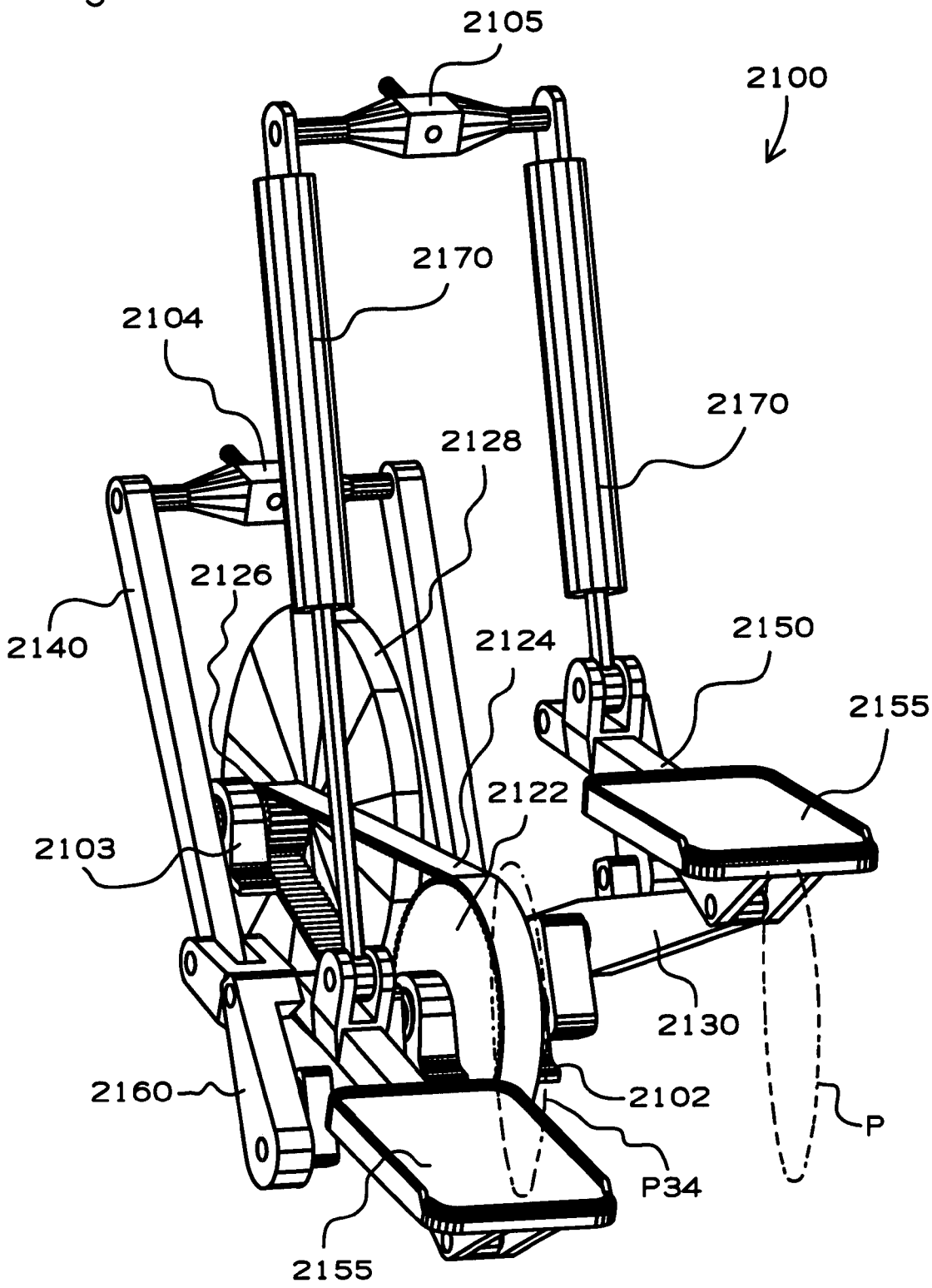
FIG. 1 is a perspective view of first exercise apparatus constructed according to the principles of the present invention.
Figure 2:
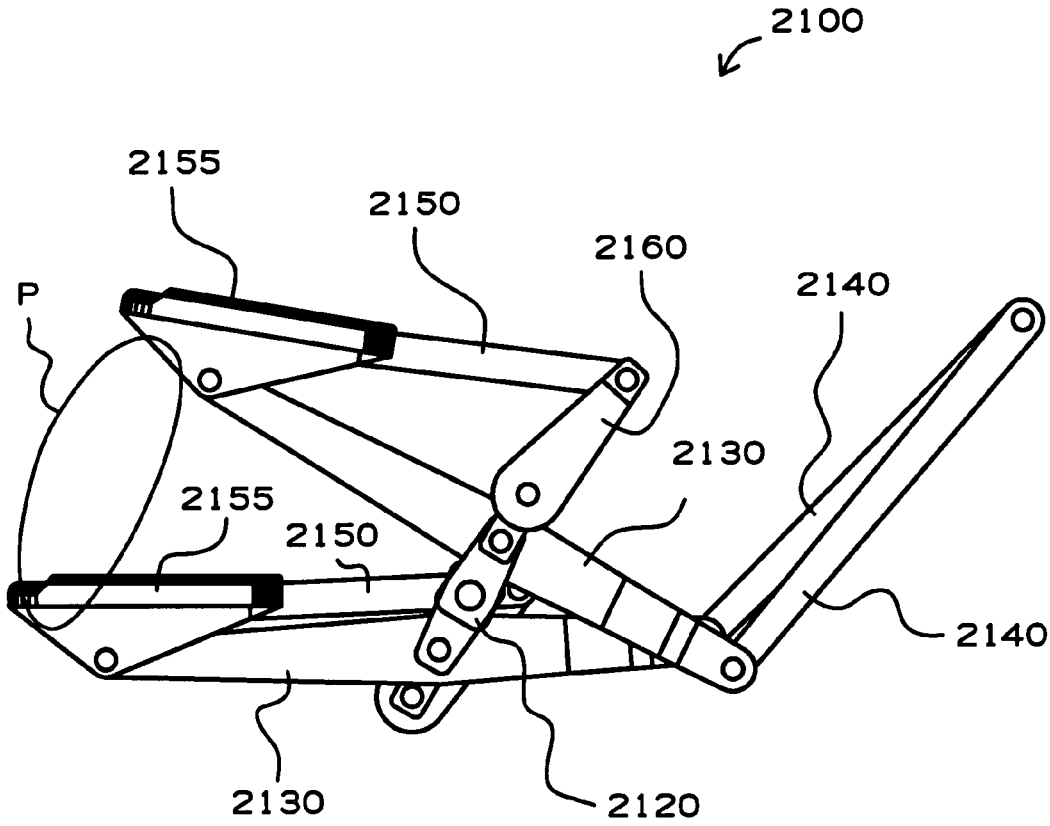
FIG. 2 is a side view of a portion of the exercise apparatus of FIG. 1.

FIGS. 1-2 show a first exercise apparatus 2100 constructed according to the principles of the present invention. The exercise apparatus 2100 includes left and right cranks 2120 rotatably connected to a frame by means of a crank shaft and bearing assemblies 2102. A larger diameter pulley 2122 is keyed to the crank shaft and rotates together with the cranks 2120 about a common crank axis. A belt 2124 connects the pulley 2122 to a smaller diameter pulley 2126 which is rigidly secured to a flywheel 2128. The pulley 2126 and the flywheel 2128 are rotatably connected to the frame by means of a flywheel shaft and bearing assemblies 2103. As a result, the pulley 2126 and the flywheel 2128 rotate at a relative faster rotational velocity than the cranks 2120 and pulley 2122. A conventional resistance device may be connected to the flywheel 2128 to resist rotation thereof.

Left and right connector links 2130 have intermediate portions which are rotatably connected to radially displaced portions of respective cranks 2120. The connector links 2130 have first ends which are rotatably connected to first ends of respective rocker links 2140, and second, opposite ends which are connected to respective foot supporting members or foot links 2150. The rocker links 2140 have second, opposite ends which are rotatably connected to the frame by means of frame member 2104.

One end of each foot supporting member 2150 is rotatably connected to a respective connector link 2130, and an opposite end of each foot supporting member 2150 is rotatably connected to an end of a respective floating crank or intermediate link 2160. An opposite end of each floating crank 2160 is rotatably connected to a distal end of a respective crank 2120. Left and right foot platforms 2155 are mounted on respective foot supporting members 2150 proximate their pivotal connections with respective connector links 2130. The floating cranks 2160 and pivoting foot supporting members 2150 cooperate to maintain the foot platforms 2155 in relatively favorable orientations throughout an exercise cycle.

Optional left and right dampers 2170 are rotatably interconnected between frame member 2105 and intermediate portions of respective foot supporting members 2150. The arrangement is such that the dampers 2170 tend to resist vertical movement of the foot platforms 2155 without unduly interfering with "over center" rotation of the cranks 2120.

FIGS. 3A-3L show a second exercise apparatus 2200 which is constructed according to the principles of the present invention, and which is similar in many respects to the first exercise apparatus 2100. For ease of illustration and discussion, only one side of the exercise apparatus 2200 is shown (with the understanding that opposite side counterparts function in similar fashion, but typically one hundred and eighty degrees out of phase with the depicted parts). The side of the apparatus 2200 shown in FIGS. 3A-3L is the right side of the apparatus 2200, meaning that a user will be encouraged to mount the machine 2200 with his toes extending toward the rocker links 2240.

Figure 3A:
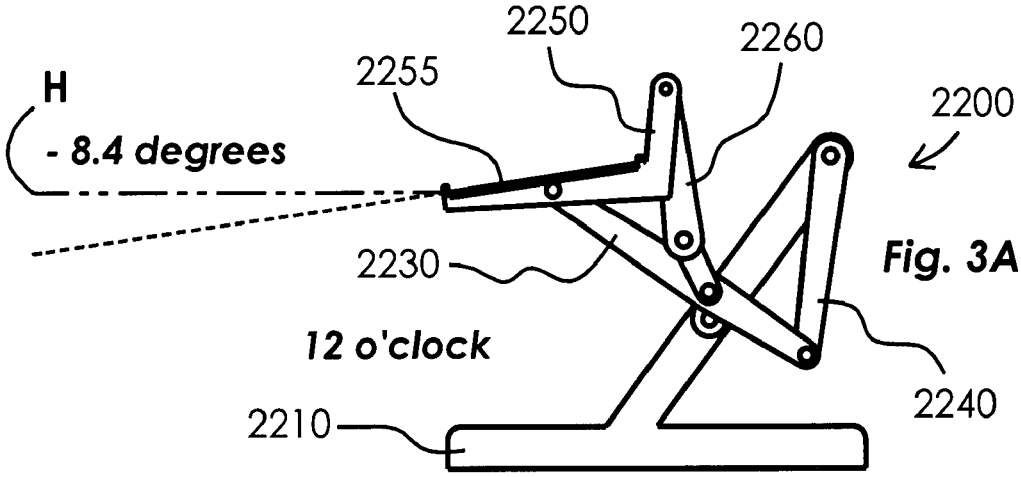
FIGS. 3A-3L are side views of a second exercise apparatus constructed according to the principles of the present invention, showing one side of the second exercise apparatus at different points during an exercise cycle.
Figure 3B:
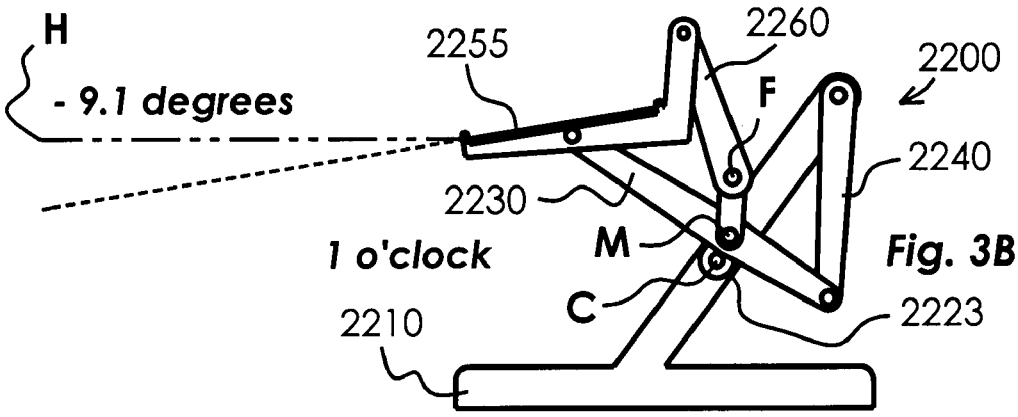
Figure 3C:
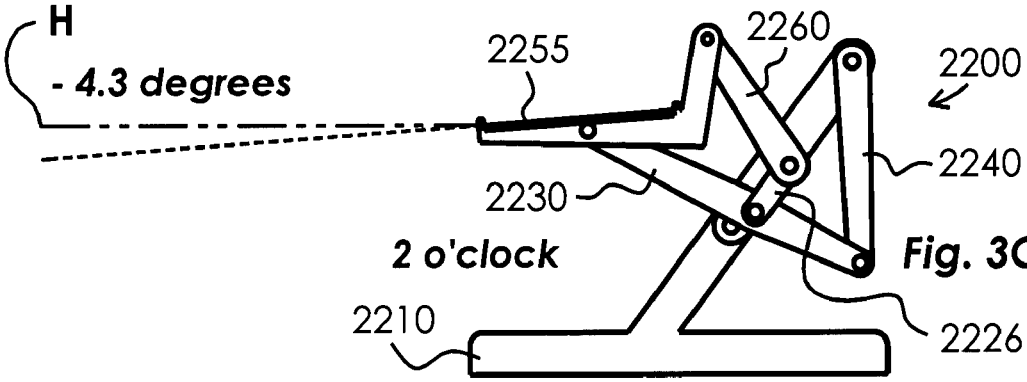
Figure 3D:
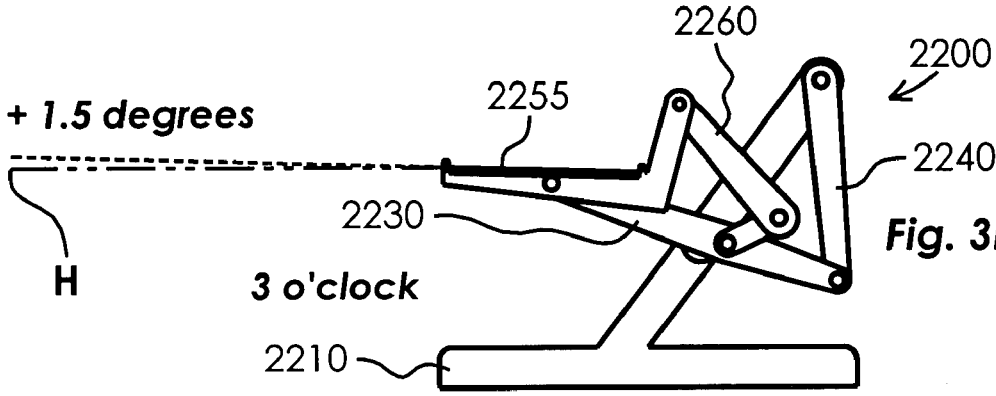
Figure 3E:
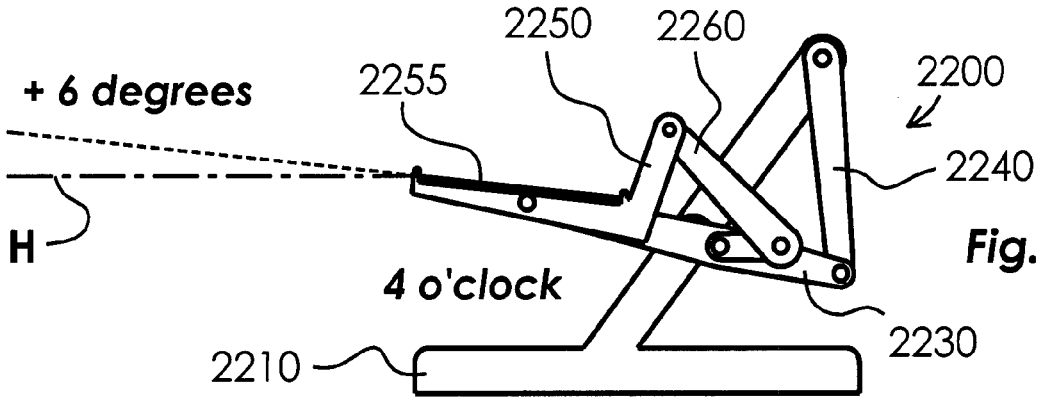
Figure 3F:
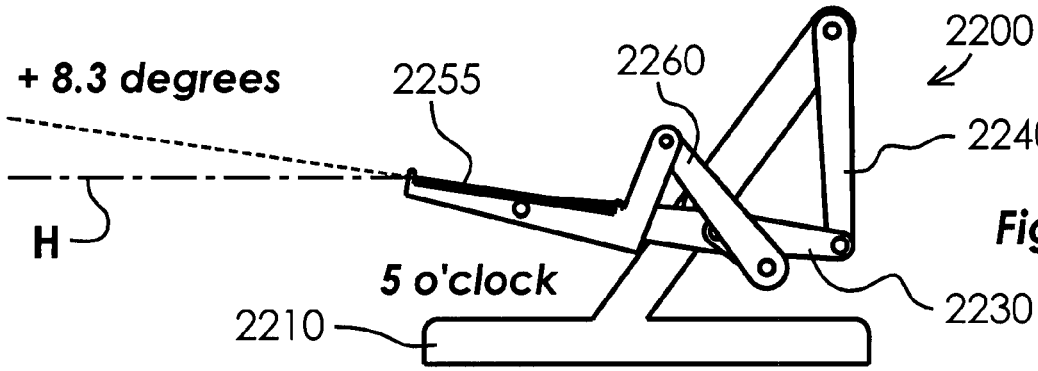
Figure 3G:
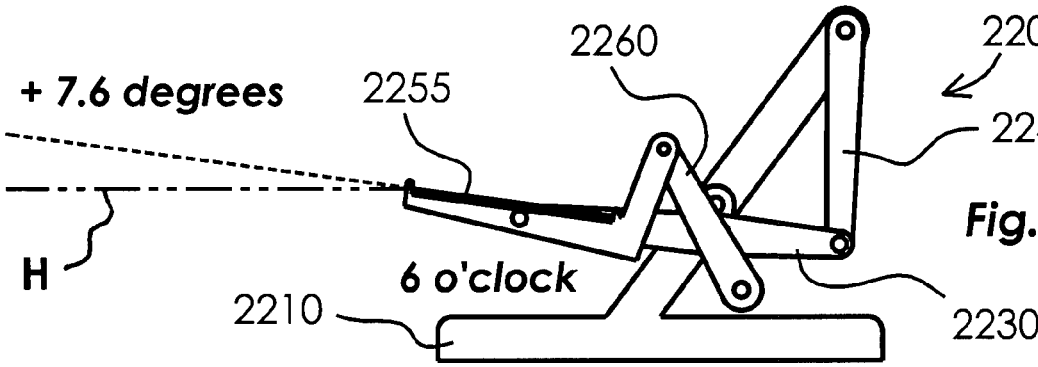
Figure 3H:
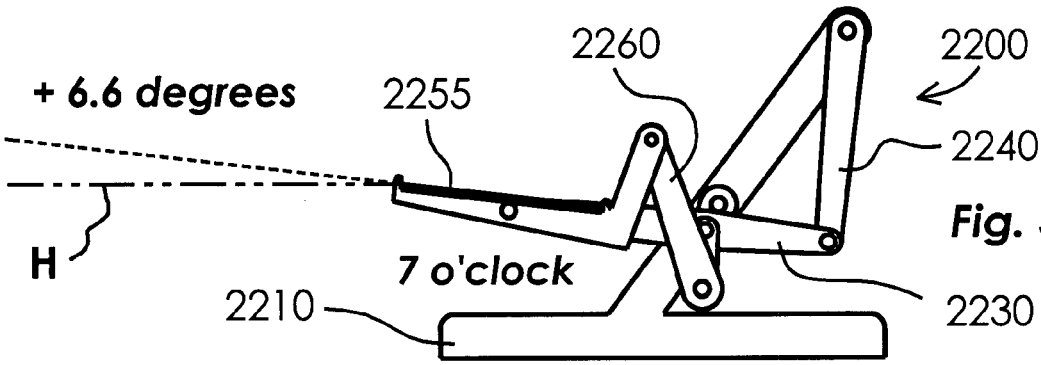
Figure 3I:
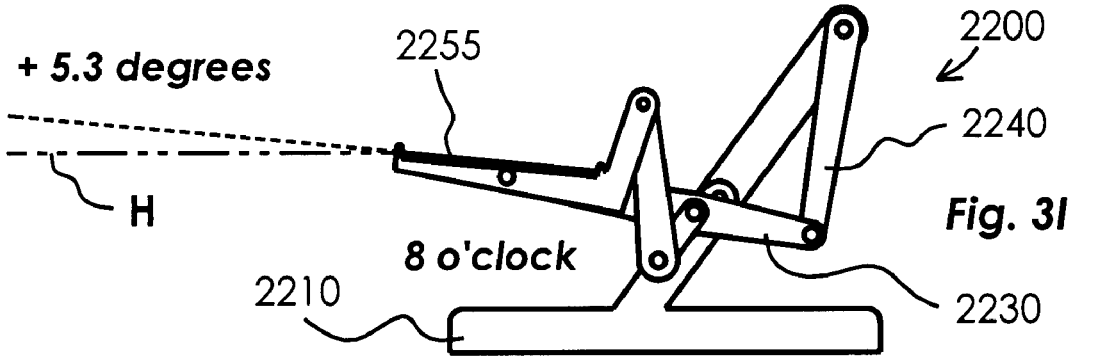
Figure 3J:
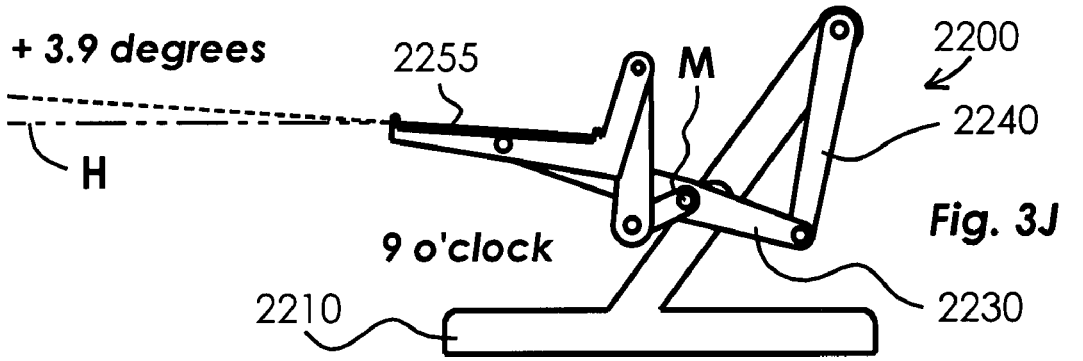
Figure 3K:
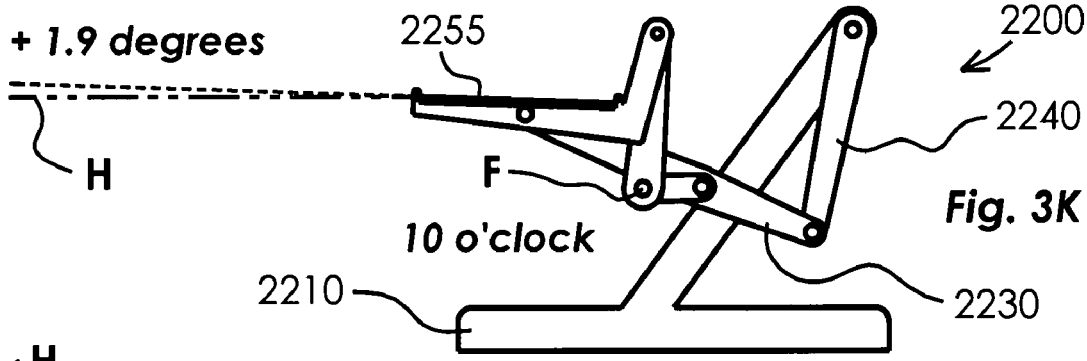
Figure 3L:
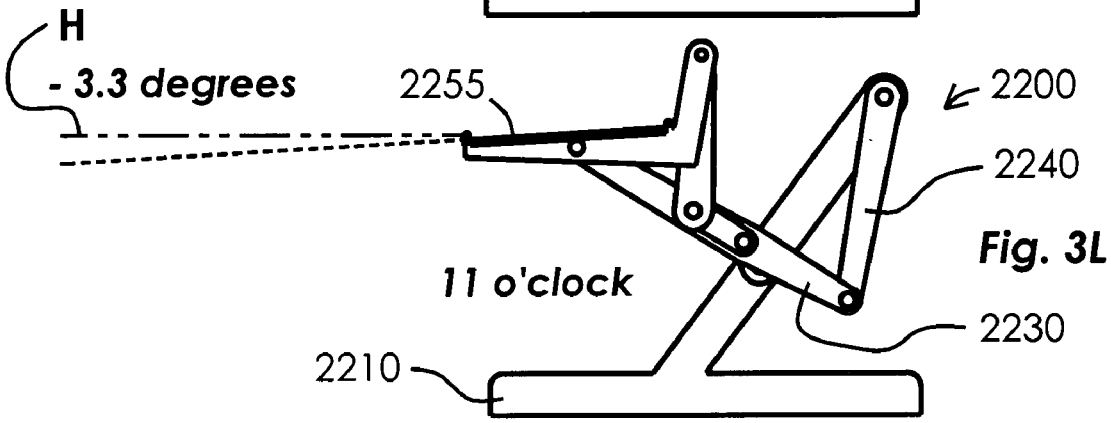
Figure 4A:
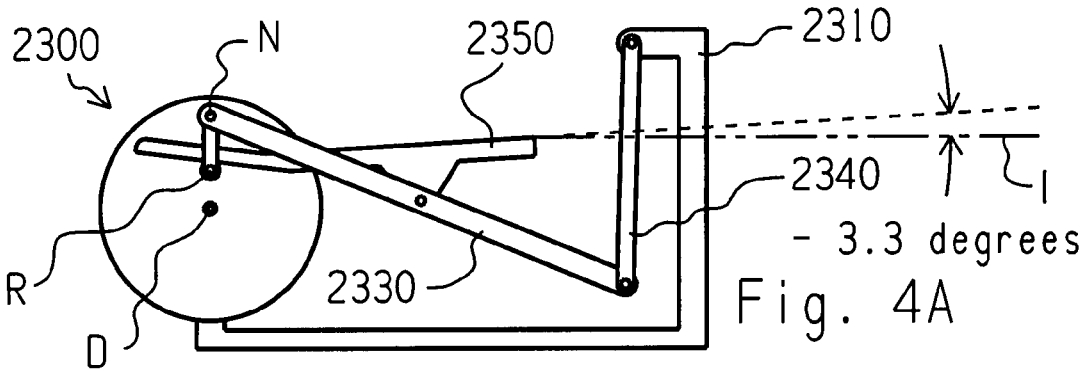
FIGS. 4A-4L are side views of a third exercise apparatus constructed according to the principles of the present invention, showing one side of the third exercise apparatus at different points during an exercise cycle.
Figure 4B:
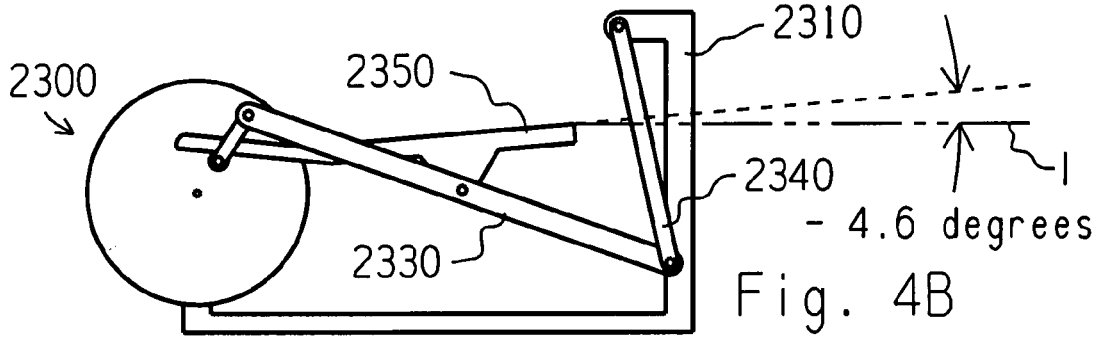
Figure 4C:
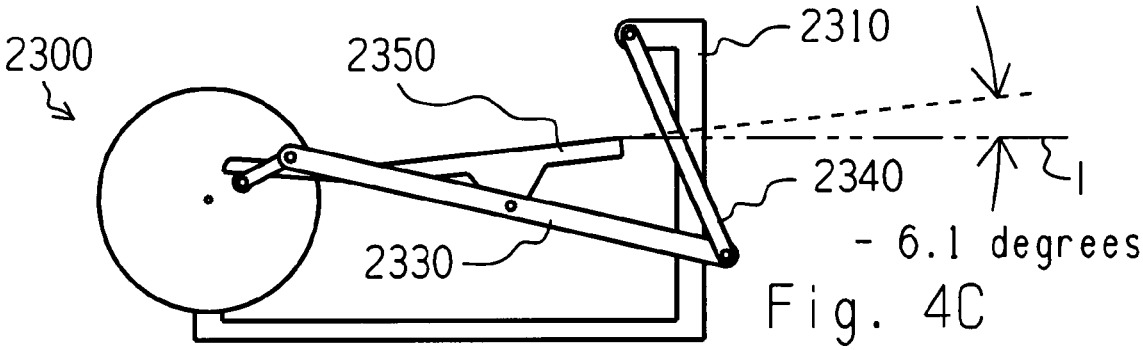
Figure 4D:
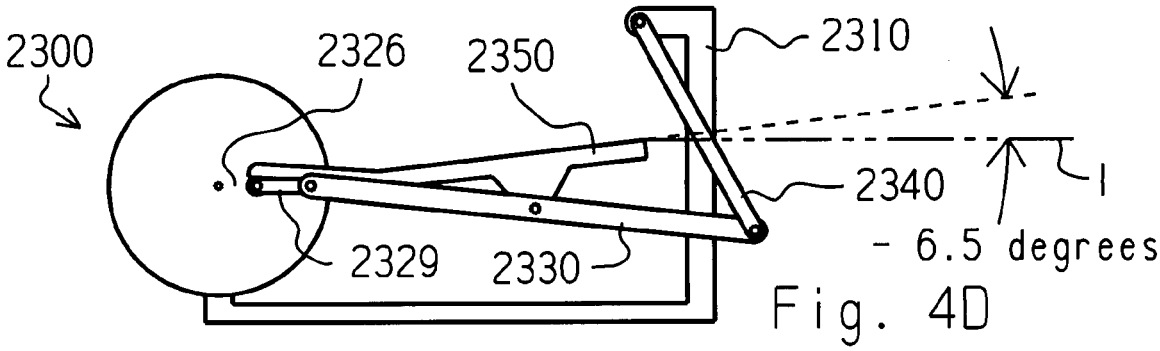
Figure 4E:
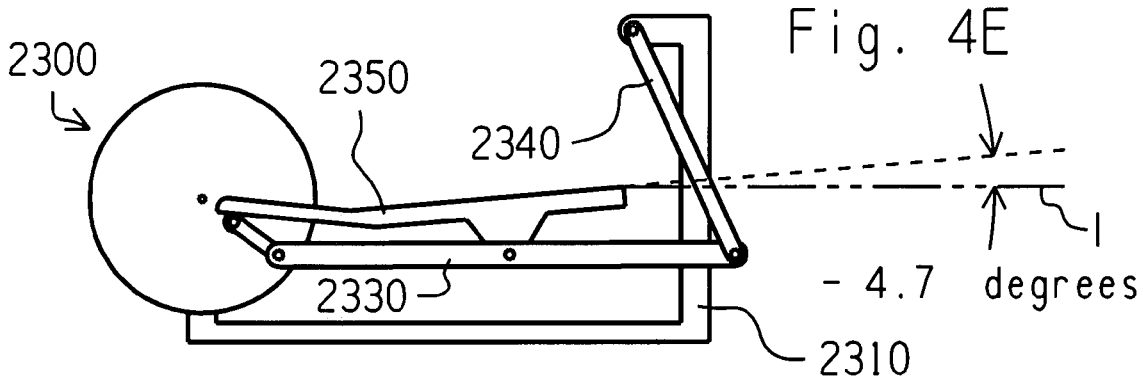
Figure 4F:
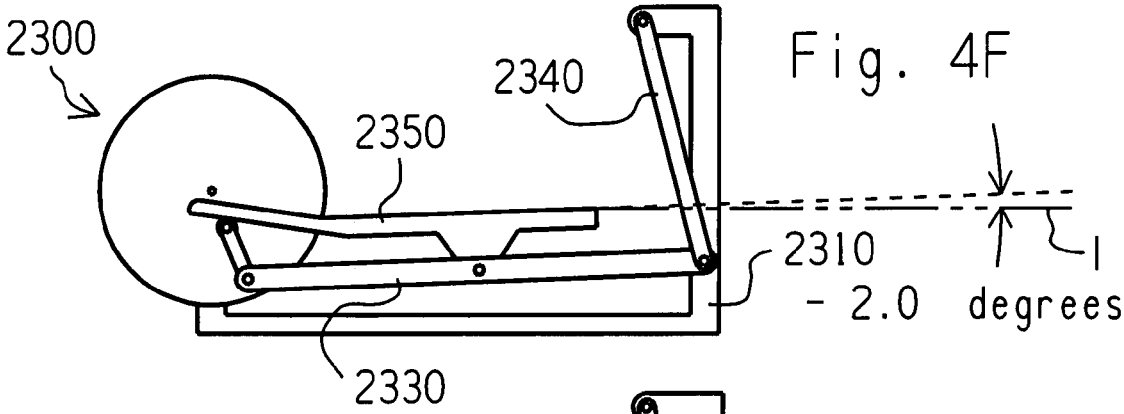
Figure 4G:
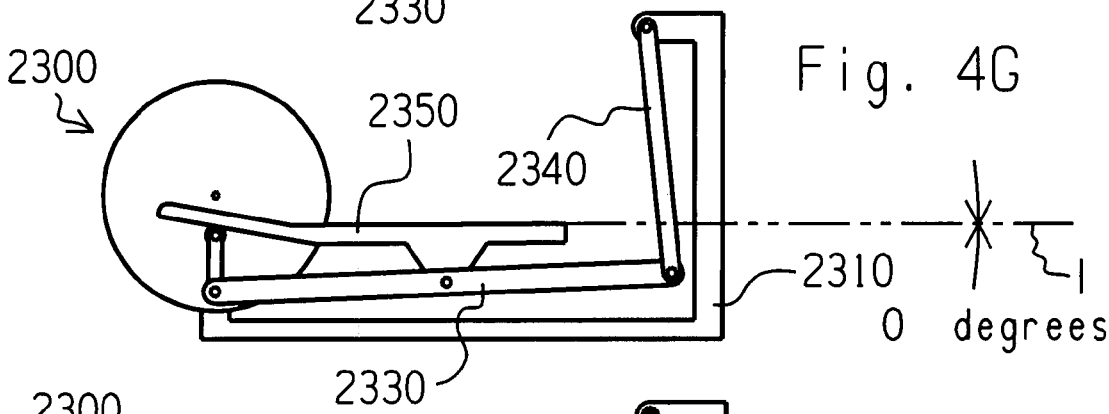
Figure 4H:
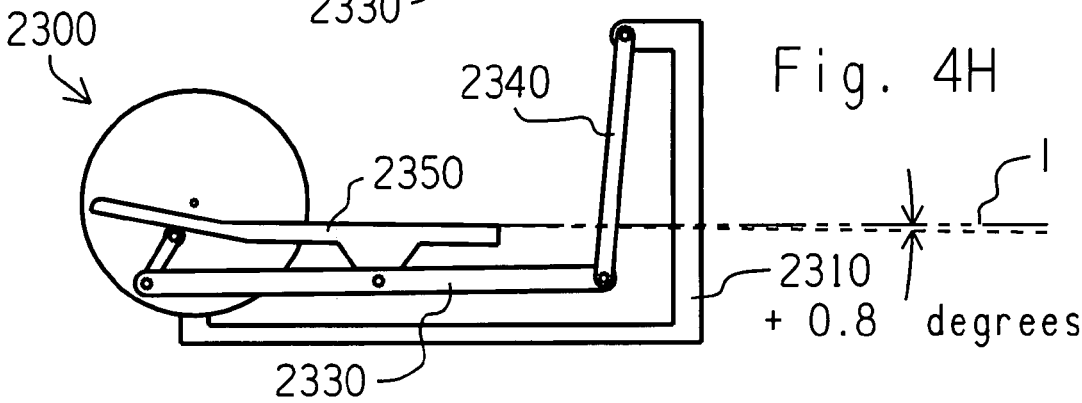
Figures 4I, 4J, 4K, 4L:
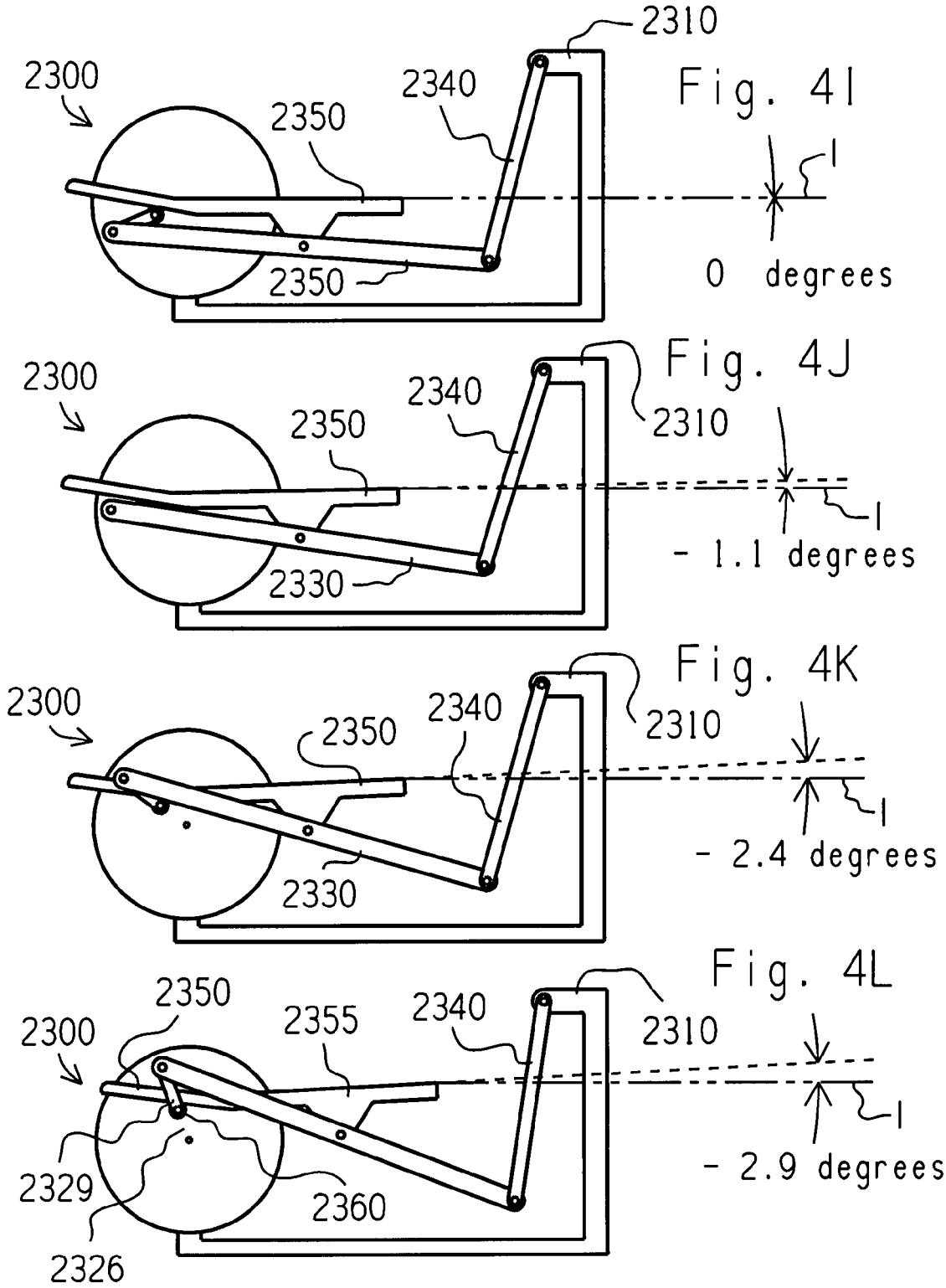

The exercise apparatus 2200 includes left and right cranks rotatably connected to a frame 2210 by means of a crank shaft and bearing assemblies. As shown in FIGS. 3B and 3C, each crank includes (1) a first crank arm 2223 having a first end rotatably connected to the frame 2210 at crank axis C, and an opposite, second end rotatably connected to a respective connector link 2230 at a respective connector link axis M; and (2) a second crank arm 2226 having a first end rotatably connected to the frame 2210 at crank axis C (via a rigid connection to the second end of the first crank segment 2223), and an opposite second end rotatably connected to a respective floating link or intermediate link 2260 at a respective floating crank axis F. Various conventional inertial devices and/or resistance devices many be connected to the cranks (directly or indirectly) by means known in the art.

The left and right connector links 2230 have intermediate portions that are rotatably connected to the distal ends of respective crank arms 2223. The connector links 2230 have first ends that are rotatably connected to first ends of respective rocker links 2240, and second, opposite ends that are rotatably connected to respective foot supporting members or foot links 2250. The rocker links 2240 have second, opposite ends that are rotatably connected to the frame 2210. Those skilled in the art will recognize that the rocker links 2240 may be described as guides that direct the first ends of the connector links 2230 through respective reciprocal paths, and that this function may alternatively be performed by rollers rotatably mounted on the first ends of the connector links 2230 and rollable along a portion of the frame 2210.

A first portion of each foot supporting member 2250 is rotatably connected to a respective connector link 2230, and a second portion of each foot supporting member 2250 is rotatably connected to an end of a respective floating crank 2260. As noted above, an opposite end of each floating crank 2260 is rotatably connected to a distal end of a respective crank arm 2226. Left and right foot platforms 2255 are provided on respective foot supporting members 2250, and are configured to support a person's respective feet.

The machine 2200 operates in the same general manner as the machine 2100 shown in FIGS. 1-2. However, the linkage assembly components on the machine 2200 are configured in a somewhat different manner in order to move the foot platforms 2255 in a manner inconsistent with the "heel rise" limitation recited in the claims of the aforementioned Miller patents. In this regard, FIGS. 3A-3L show the right side of the machine 2200 as the right crank 2220 is rotated in thirty degree intervals throughout an exercise cycle. The axis M reaches a rearwardmost, 9:00 position in FIG. 3J; the axis F reaches a rearwardmost position as the axis M rotates clockwise beyond its 10:00 orientation shown in FIG. 3K; and the right rocker link 2240 pivots to a rearwardmost position as the axis M rotates clockwise beyond the 10:00 position shown in FIG. 3K. As suggested by the reference lines and associated angular measurements (where H is horizontal or parallel to the floor, and the other dashed line is parallel to the foot supporting surface on the right foot platform 2255), the right foot platform 2255 is not experiencing faster heel rise than toe rise at any time between the 8:00 position shown in FIG. 3I and the 1:00 position shown in FIG. 3B. In other words, the heel portion of the foot platform 2255 does not rise faster than the toe portion of the foot platform 2255 as the forward end of the connector link 2230 begins moving forward from a point at a rearward end of its path.

FIGS. 4A-4L show a third exercise apparatus 2300 which is constructed according to the principles of the present invention, and which also accommodates foot motion that is inconsistent with the "heel rise" limitation recited in the claims of the aforementioned Miller patents. For ease of illustration and discussion, only one side of the exercise apparatus 2300 is shown (with the understanding that opposite side counterparts function in similar fashion, but typically one hundred and eighty degrees out of phase with the depicted parts). The side of the apparatus 2300 shown in FIGS. 4A-4L is the right side of the apparatus 2300, meaning that a user will be encouraged to mount the machine 2300 with his toes extending toward the rocker links 2340.

The exercise apparatus 2300 includes left and right cranks rotatably connected to a frame 2210 by means of a crank shaft and bearing assemblies. The cranks rotate about a crank axis D relative to the frame 2310. Each crank includes (1) a first crank arm having a distal end that is rotatably connected to a respective connector link 2330 at a connector link axis N; and (2) a second crank arm 2326 having a distal end that rotatably supports a respective roller or intermediate link 2360 at a roller axis R. A crank extension 2329 is rigidly interconnected between the distal end of the second crank arm 2326 and the distal end of the first crank arm to prevent interference between the parts during operation of the machine 2300. Various conventional inertial devices and/or resistance devices many be connected to the cranks (directly or indirectly) by means known in the art.

The left and right connector links 2330 have rearward ends that are rotatably connected to the distal ends of respective crank extensions 2329. The connector links 2330 have opposite, forward ends that are rotatably connected to lower ends of respective rocker links 2340, and intermediate portions that are rotatably connected to respective foot supporting members or foot links 2350. The rocker links 2340 have opposite, upper ends that are rotatably connected to the frame 2310. Those skilled in the art will recognize that the rocker links 2340 may be described as guides that direct the first ends of the connector links 2330 through respective reciprocal paths, and that this function may alternatively be performed by rollers rotatably mounted on the first ends of the connector links 2330 and rollable along a portion of the frame 2310. Those skilled in the art will also recognize that the rocker links 2340 may be extended upward beyond their pivot axis, in which case, the upper distal ends of the extended rocker links may be configured for use as handlebars to facilitate upper body exercise together with the lower body exercise.

A forward portion of each foot supporting member 2350 is rotatably connected to the intermediate portion of a respective connector link 2330, and a rearward portion of each foot supporting member 2250 is rotatably supported on a respective roller 2360. As noted above, each roller 2360 is mounted on a respective crank at the distal end of a respective crank arm 2326. Those skilled in the art will recognize that low friction bearing surfaces and/or telescoping assemblies may be substituted for the rollers 2360 without departing from the scope of the present invention. In any event, each foot supporting member 2350 is provided with a foot platform 2355 configured to support a person's foot.

FIGS. 4A-4L show the right side of the machine 2300 as the right crank 2320 is rotated in thirty degree intervals throughout an exercise cycle. The axes N and R reach a rearwardmost, 9:00 position, in FIG. 4J; and the right rocker link 2340 pivots to a rearwardmost position as the axes N and R rotate from the 9:00 position in FIG. 4J to the 10:00 position in FIG. 4K. As suggested by the reference lines and associated angular measurements (where I is horizontal or parallel to the floor, and the other dashed line is parallel to the foot supporting surface on the right foot platform 2355), the right foot platform 2355 is not experiencing faster heel rise than toe rise at any time between the 7:00 position shown in FIG. 4H and the 3:00 position shown in FIG. 4D. In other words, the heel portion of the foot platform 2355 does not rise faster than the toe portion of the foot platform 2355 as the forward end of the connector link 2330 begins moving forward from a point at a rearward end of its path.

The foregoing disclosure is directed toward specific embodiments and a particular application with the understanding that persons skilled in the art will be able to derive additional embodiments, modifications, and/or features that nonetheless fall within the scope of the present invention. Therefore, the scope of the present invention is to be limited only to the extent of the claims which follow.

What is claimed is:

1. A method of facilitating elliptical exercise, comprising the steps of:

providing a frame adapted to rest on a floor surface;

rotatably mounting left and right cranks on the frame;

movably mounting left and right guides on the frame for movement in oscillatory fashion relative thereto;

movably interconnecting left and right connector links between respective said cranks and respective said guides;

movably connecting left and right foot supporting links to respective said connector links; and movably interconnecting left and right intermediate links between respective said cranks and respective said foot supporting links.

2. The method of claim 1, wherein the step involving the intermediate links involves pivotally interconnecting the intermediate links between respective said cranks and respective said foot supporting links.

* * * * *